US006277029B1

(12) United States Patent
Hanley, Jr.

(10) Patent No.: US 6,277,029 B1
(45) Date of Patent: Aug. 21, 2001

(54) GOLF ELECTRONIC SCORING DEVICE

(75) Inventor: Donald Lee Hanley, Jr., Salt Lake City, UT (US)

(73) Assignee: Stat Tracker II, L.L.C., Park City, UT (US)

( * ) Notice: Subject to any disclaimer, the term of this patent is extended or adjusted under 35 U.S.C. 154(b) by 0 days.

(21) Appl. No.: 09/545,684

(22) Filed: Apr. 7, 2000

Related U.S. Application Data

(60) Provisional application No. 60/128,259, filed on Apr. 8, 1999.

(51) Int. Cl.[7] ..... A63B 57/00
(52) U.S. Cl. ..... 473/131; 700/92
(58) Field of Search ..... 700/92; 473/131, 473/150–156, 409, 407

(56) References Cited

U.S. PATENT DOCUMENTS

| | | | | |
|---|---|---|---|---|
| 4,266,214 | * | 5/1981 | Peters, Jr. | 340/323 R |
| 5,153,826 | * | 10/1992 | Johnson | 364/410 |
| 5,319,548 | * | 6/1994 | Germain | 364/410 |
| 5,681,108 | * | 10/1997 | Miller | 364/411 |
| 5,779,566 | * | 7/1998 | Wilens | 473/407 |
| 6,122,559 | * | 9/2000 | Bohn | 700/91 |

* cited by examiner

*Primary Examiner*—Jessica J. Harrison
*Assistant Examiner*—Kim T. Nguyen
(74) *Attorney, Agent, or Firm*—Madson & Metcalf

(57) ABSTRACT

The present invention provides a hand-held portable device capable of tracking and incorporating valuable golf performance statistics to allow a player to identify weaknesses in game play. The present invention includes a hand-held device for storing and processing golf scores. The device has a logic device for processing executable commands and is in electrical communication with a memory, an input device, and an output device. The memory includes an interface module configured to generate prompts for player identification and performance data. The prompts are displayed on the output device. The performance data reflects golf scores and other areas of objective performance on the golf course. As the performance data is entered it is stored in a memory in association with a player identification. The memory further includes a statistic module configured to generate performance statistics based on the performance data. The performance statistics provide valuable feedback relating to a player's areas of strengths and weaknesses. The performance statistics may be consolidated and averaged over a single round of golf or over a plurality of rounds. The interface module is further configured to generate a player report incorporating the performance data, the performance statistics, and the player information. The player report may be displayed on the output device in a matrix format.

17 Claims, 5 Drawing Sheets

Sample Screen

| Round | 1 | 2 | 3 | 4 | 5 | 6 | 7 | 8 | 9 | 10 | 10 Round Review | Goals | Variance |
|---|---|---|---|---|---|---|---|---|---|---|---|---|---|
| Date | 4/3/98 | 4/7/98 | 4/10/98 | 4/14/98 | 4/20/98 | 4/24/98 | 4/29/98 | 5/1/98 | 5/3/98 | 5/5/98 | | | |
| Course | Bonnie | Murry | Wing | Old Mill | Thanks | Bonnie | PC | Wasatch | Murry | Forest | | | |
| Drive FWY% | 75 | 62.5 | 68.8 | 56.3 | 50 | 31.3 | 56.3 | 31.3 | 432.8 | 37.5 | 45.6% | 50 | <4.4> |
| Ave. Drive | 236 | 245 | 254 | 230 | 250 | 230 | 247 | 225 | 245 | 258 | 242 | 250 | <8> |
| GIR% | 44.4 | 50 | 55.5 | 61.1 | 66.7 | 44.4 | 50 | 55.5 | 61.1 | 66.7 | 55.5% | 50 | +5.5 |
| U/D% | 40 | 44.4 | 50 | 57.1 | 33.3 | 60 | 55.5 | 37.5 | 42.9 | 16.7 | 45 | 50 | <5> |
| SS% | 50 | 66.6 | 25 | 100 | 50 | 33.3 | 40 | 50 | 33.3 | 33.3 | 41.2 | 50 | <8.8> |
| Putts | 34 | 33 | 31 | 35 | 36 | 30 | 29 | 34 | 34 | 35 | 33.1 | 32 | +1.1 |
| Putts/Hole | 1.89 | 1.83 | 1.72 | 1.94 | 2.0 | 1.67 | 1.61 | 1.89 | 1.89 | 1.94 | 7.84 | 1.78 | +.06 |
| Putts/GIR | 2.0 | 2.11 | 1.9 | 2.18 | 2.08 | 2.0 | 1.89 | 2.1 | 2.0 | 2.0 | 2.03 | 2.0 | +.03 |
| Score | 80 | 80 | 75 | 78 | 78 | 76 | 76 | 78 | 77 | 77 | 77.5 | 78 | <.5> |

FIG. 5

GOLF ELECTRONIC SCORING DEVICE

RELATED APPLICATIONS

This application claims priority to U.S. patent application Ser. No. 60/128,259, filed Apr. 8, 1999.

BACKGROUND OF THE INVENTION

1. Field of the Invention

The invention relates to the field of electronic devices for golf scoring. More specifically, the invention relates to electronic devices which further provide statistical analysis of golf scores and performance of one or more players.

2. Relevant Technology

The game of golf enjoys much popularity as a recreational sport for both amateur and professional players. Indeed, across the world and nation the sport attracts numerous avid players. Golfing is played from the amateur level to the professional tournament level and has promoted certain players to celebrity status. The golfing industry anticipates that the appeal will continue to attract players both young and old and resources will continue to fuel the sport.

As with most sports, golf generates statistics which reflects a player's performance. Reviewing and analyzing a player's statistics reveals a player's strengths and weaknesses. Thus, although practice is required to improve performance, knowledge of a weakness will allow a player to focus and concentrate on that weakness. Serious golfers take great efforts to record their scores and statistics and review them for improvement.

Although recording some of the basic scores in a round of golf is a simple matter, calculating statistics based on the scores is a tedious matter. In a single round of golf, the statistical calculations soon become numerous. The calculations are increased substantially where several players are involved. Frequently interrupting game play to calculate statistics detracts from the enjoyment of the game. Furthermore, although beneficial, it is inconvenient and tedious to average and consolidate statistics of a single round of golf with previous rounds to provide an overview of a player's performance.

Thus, it would be an advancement in the art to provide an apparatus and method for storing and processing golf scores to produce statistics for a player.

It would be a further advancement in the art to provide an apparatus which is hand-held to facilitate portability around a golf course.

It would be yet another advancement in the art to provide an apparatus and method for consolidating and averaging statistics for a plurality of rounds of golf to better indicate a golfer's performance, improvement, and of weaknesses.

Such a device is disclosed herein.

SUMMARY OF THE INVENTION

The present invention solves the foregoing problems by providing a hand-held device for storing and processing golf scores. The device includes a logic device for processing executable commands and is in electrical communication with a memory, an input device, and an output device. The memory includes an interface module configured to generate prompts for player identification and performance data. The prompts are displayed on the output device. The performance data reflects golf scores and other areas of objective performance on the golf course.

As the performance data is entered it is stored in a memory in association with a player identification. The memory further includes a statistic module configured to generate performance statistics based on the performance data. The performance statistics provide valuable feedback relating to a player'areas of strengths and weaknesses. The performance statistics may be consolidated and averaged over a single round of golf or over a plurality of rounds. The interface module is further configured to generate a player report incorporating the performance data, the performance statistics, and the player information. The player report may be displayed on the output device in a matrix format. The invention provides an apparatus and method to facilitate recordation of golf scores and generation of statistics to allow a player to identify areas of improvement.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which:

FIG. 5 illustrates a sample screen displaying performance results in a matrix format.

DETAILED DESCRIPTION OF THE PREFERRED EMBODIMENTS

A preferred embodiment of the invention is now described with reference to the FIGS. 1–5, where like reference numbers indicate identical or functionally similar elements. The components of the present invention, as generally described and illustrated in the Figures, may be implemented in a wide variety of configurations. Thus, the following more detailed description of the embodiments of the system and method of the present invention, as represented in the Figures, is not intended to limit the scope of the invention, as claimed, but is merely representative of presently preferred embodiments of the invention.

Various components of the invention are described herein as "modules." In one embodiment, the modules may be implemented as software, hardware, firmware, or any combination thereof. For example, as used herein, a module may include any type of computer instruction or computer executable code located within a memory device and/or transmitted as electronic signals over a system bus or network. An identified module may, for instance, comprise one or more physical or logical blocks of computer instructions, which may be organized as an object, procedure, function, or the like.

Nevertheless, the identified modules need not be located together, but may comprise disparate instructions stored in different locations, which together implement the described functionality of the module. Indeed, a module may comprise a single instruction, or many instructions, and may even be distributed over several different code segments, among different programs, and across several memory devices.

Figure 1:
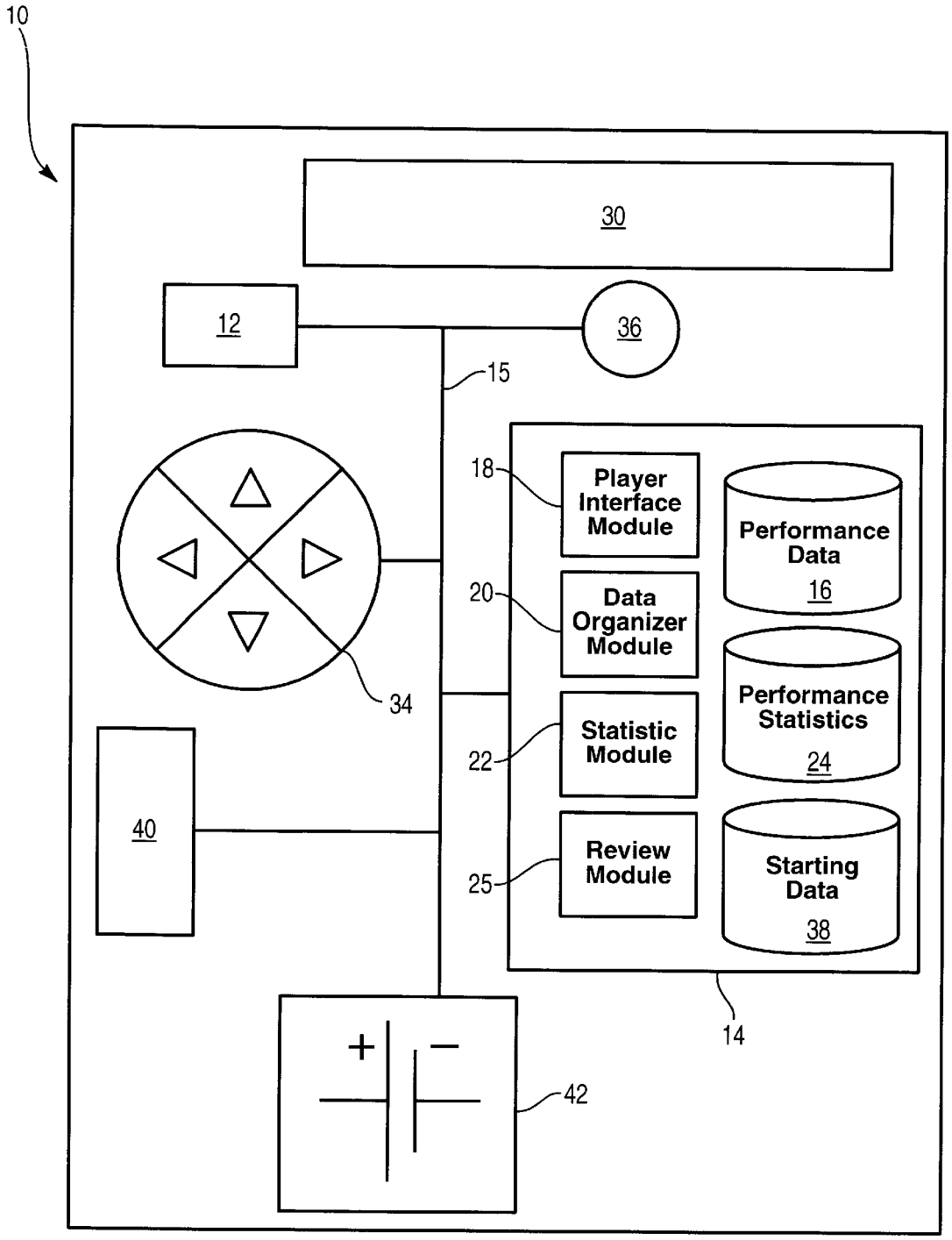
FIG. 1 is a block diagram of on embodiment of the scoring device of the present invention.

Referring to FIG. 1, a schematic block diagram illustrating one embodiment of the portable scoring device 10 of the present invention is shown. The device 10 is preferably configured to be hand held to facilitate portability of the device during game play. In one embodiment, the device 10 may be three inches wide, five inches in length, and ½ inch in thickness. The size and configuration f the device 10 preferably ranges from small credit-card size devices to larger palm-size devices. Easy portability is an advantageous feature of the device 10.

The device 10 includes a logic device 12 configured to perform functions of the present invention. These functions include capturing and downloading data, calculating specific results, storing results to be used as input for end of round calculations, and calculating historical averages for each statistical category. The logic device 12 may be embodied as a central processing unit (CPU), microprocessor, a general purpose programmable device, application specific hardware, a slate machine, or other processing machine.

The device 10 further includes a memory 14 which is in electrical communication with the logic device 12 through a bus 15. The memory 14 may include a non-volatile memory to retain data when the device 10 is off. The memory 14 is capable of storing performance data 16 reflecting player scores for 100 rounds. The 100 rounds may be attributed to 1 to 100 players. For example, five rounds may be stored for 20 players, ten rounds may be stored for ten players, and so forth. Rounds specific to a player may be stored in association with a player identification number.

The memory 14 includes modules to provide programming to the logic device 12. The memory 14 includes an interface module 18 configured to provide options and prompts to a player, receive input from a player, and perform overall management functions. The memory 14 further includes a data organizer module 20 configured to format, access, and store performance data 16. The memory 14 also includes a statistic module 22 configured to generate performance statistic 24 based on performance data 16. The statistic module 22 may store the performance statistics 24 in the memory 14 for subsequent retrieval, review and analysis.

The memory 14 may further contain a review module 25 configured to allow a player to review performance data 16 and performance statistics 24 during and after game play. The review module 25 may be further configured to allow a player to make revisions or corrections to performance data 16 during game play. The review module 25 may present the performance data 16 and statistics to the interface module 18 for viewing in a variety of formats. For example, the interlace module 18 may display performance data and statistics 16, 24 in a chronological format, by specific courses played, by individual elements, or by showing results for the last 10 rounds given a certain desired element. The review module 25 may further compare a player's performance data and statistics 16, 24 to pre-established goals with variances calculated.

The device 10 includes an output device 30 which may be embodied as a liquid crystal display (LCD) having two rows and 16 columns. It will be appreciated by those having ordinary skill in the art that other display device configurations may be used as well. The interface module 18 may generate prompts, such as a menu, for input from a player. The menu or other types of prompts may be displayed on the output device 30. The interface module 18 may further assemble and display performance data 16 and performance statistics 24 in a variety of formats.

The device 10 may further include an input device 32 to input data. In one presently preferred embodiment, the input device 32 may be embodied as a keypad being an approximately 1 and ½ inch diameter circle. The keypad may include buttons 34 which are ½ inches wide and ⅜ inches tall so that gloved fingers can use the keypad. The buttons 34 may be 4 arrow keys to allow a player to scroll through input options. The buttons 34 facilitate use by gloved players rather than a numerical or alphanumerical keypad.

The input device 32 may further include an On/Enter button 36 which allows a player to enter an input after a player has scrolled to the appropriate option. In one embodiment, turning the device 10 on is performed by pushing the On/Enter button 36. The device 10 is further configured to automatically turn off at the end of a round or after a certain period of time of non-use to save battery power.

The player may input player identity, course information, and performance data as the round is being played. The player interface module 18 is further configured to allow a player to enter commands to review and correct scores, download results, and save or delete performance data 16 upon completion of a round of golf.

At the beginning of a round, the interface module 18 may generate a starting screen on the output device 30 to prompt for starting data 38. The output device 30 may request the number of players, player identification, holes to be played, and the date played. The player identification may include initials, an association number, social security number, or any other identification up to a certain number of characters. After entry of a player's identification, a subsequent player's identification may be entered or the interface module 18 may proceed with entry of other input. The number of holes to be entered would be 9 or 18 as is common in the game. The starting data 38 is saved in the memory 14.

After the starting data 38 is entered, the output device 18 may prompt for performance data 16 for the first hole for each player. Each entry of performance data 16 is stored in association with a player identification. In one embodiment, the interface module 18 may display the following prompts for performance data 16 for each player:

DIF (drive in the fairway);
DrDis (average drive distance);
GIR (# greens in regulation);
UnD (# up and downs);
Sand (# sand saves);
Putts (total number putts);
Penalty (penalty strokes); and
Score (total score).

The interface module 18 may further generate an identifier for each player and hole in association with each element. For example, the output device 30 may display H1P1 DIF to signify hole one, player one, and drive in the fairway. The players enter performance data 16 for each hole and for each element. The input may be entered by selecting No, Yes, or Not Applicable options or numerical answers.

The statistic module 22 may be configured for performance data 16 taken at 9 hole and 18 hole rounds. As such, the statistic module 22 takes a percentage of the results versus absolute numbers such as Drives in Fairway, GIR, and Up and Downs when compiling totals for rounds. Putts per hole scores remain unchanged for 9 and 18 holes. Total putts, penalty strokes, and total score are multiplied by 2 for 9 hole rounds so that all compiled totals are in terms of 18 hole rounds.

The device 10 may further include a port 40 to enable communication with the device 10 and another computer device, such as a personal computer. In one embodiment, the port 40 may be embodied as a serial port. The port 40 allows the downloading of player scores and processed results to another computer for further processing or consolidation of data. Processing of scores may include individual statistical analysis, tournament scoring, or handicap calculation in accordance with an association wide handicap system. The device 10 further includes a power source 42, such as one or more conventional batteries, which is in electrical communication with the logic device 12. In operation, the device 10 allows a player to collect, compute, and store scores and compare the scores at periodic intervals to specific goals.

Figure 2:
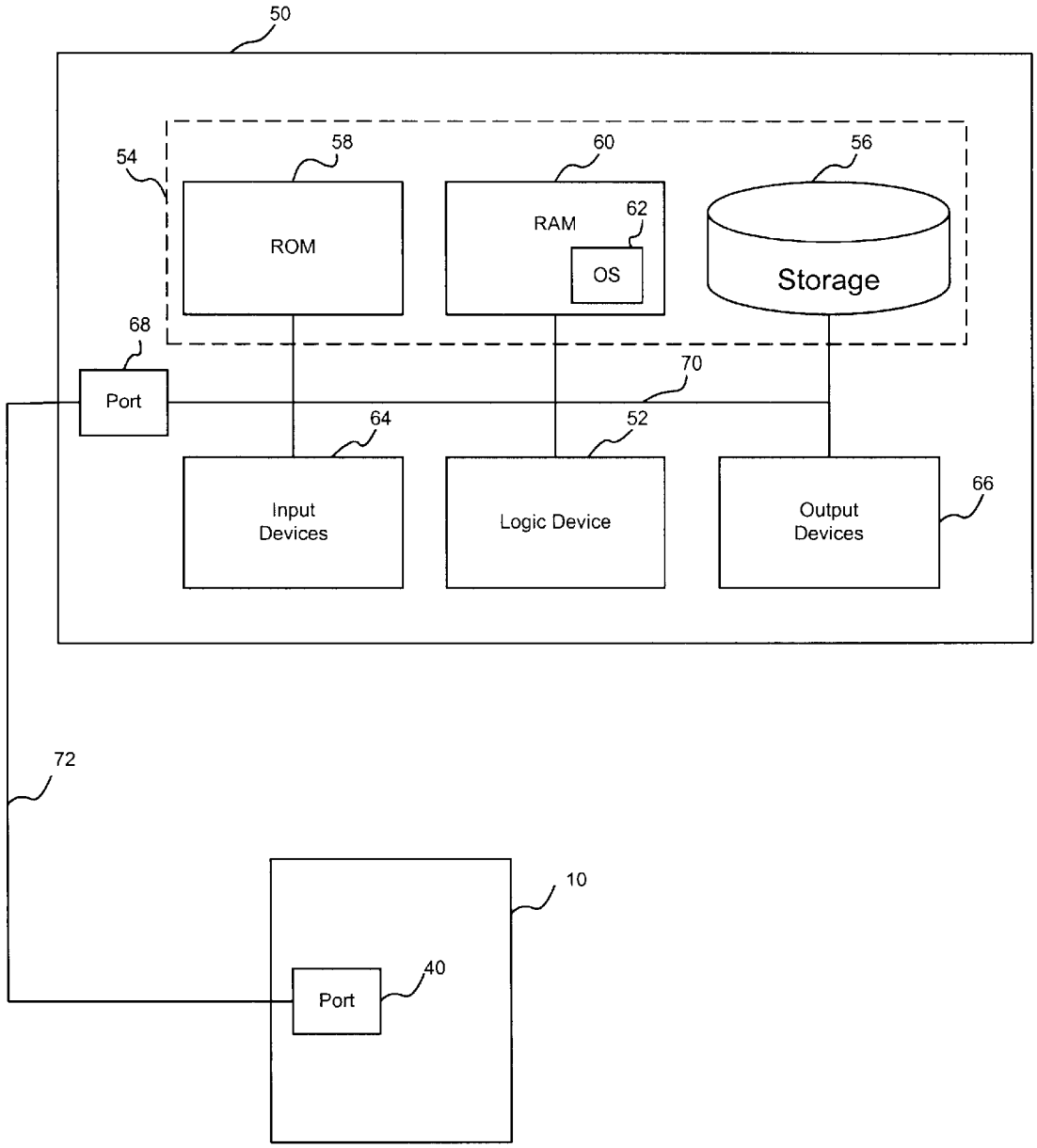
FIG. 2 is a block diagram of a golf scoring device operably connected to a workstation computer.

Referring to FIG. 2, a block diagram of the device 10 is shown in electrical communication with a computer workstation 50. The workstation 50 serves to receive performance data 16 and/or performance statistics 24 from the device 10 for storage and further analysis. The performance data 16 and the performance statistics 24 which the device 10 transmits to the workstation 50 may include scores, statistical totals, analysis of the scores, and analysis of the statistics. A typical computer workstation 50 may include a logic device 52, such as a microprocessor, which is in electrical communication with one or more memory devices 54. The memory devices 54 are depicted as including a non-volatile storage device 56, such as a hard disk drive, CD-ROM drive, tape drive, or any other suitable storage device. The memory devices 54 may further include a read-only memory (ROM) 58, and a random access volatile memory (RAM) 60. The RAM 60 may be used to store instructions by the logic device 52 during execution.

Preferably, the computer workstation 50 operates under the control of an operating system (OS) 62, such as OS/2, WINDOWS NT, WINDOWS 98, UNIX, or the like. In one embodiment, the operating system 62 may be loaded from the storage 56 into the RAM 60 at the time the workstation 50 is booted.

The computer workstation 50 may also include one or more input devices 64, such as a mouse or keyboard, for receiving inputs from a user. Similarly, one or more output devices 66, such as a monitor or printer, may be provided within, or be accessible from, the workstation 50. The workstation 50 may further include a port 68, such as a parallel port or RS-232 serial port, for electrical communication with the device 10. Within the workstation 50, a system bus 70 may operabley interconnect the logic device 52, the memory devices 54, the input devices 64, the output devices 66, and the port 68. The workstation 50 may be in communication with the device 10 through use of a communication cable 72, such as a 9 Pin cable.

The workstation 50 may further include similar modules to those found in the device 10 to enable the workstation 50 to perform similar functions. Thus, the memory 54 may include a player interface module 18, a data organizer module 20, a statistic module 22, and a review module 25. The modules, 18, 20, 22, 25 may be enhanced on the workstation 50 to take advantage of additional processing and memory resources which may not be available on the hand-held device 10.

Figure 3:
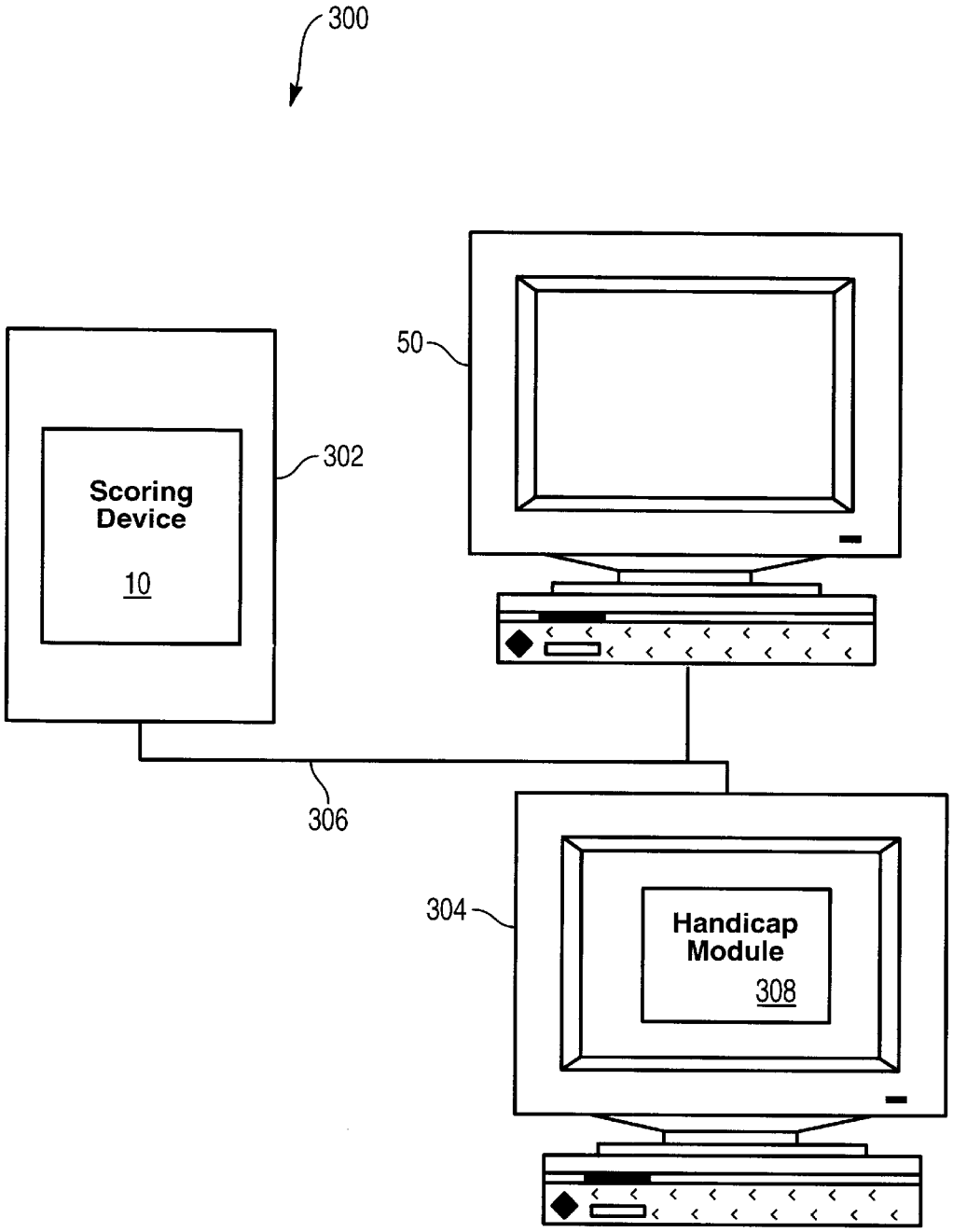
FIG. 3 is a block diagram of a golf scoring device operably connected to a workstation computer and an association terminal.

Referring to FIG. 3, a scoring system 300 is shown which incorporates the device 10 and a workstation 50. The system 300 may include a data capture device 302 or "hot box" as it is termed in the art. The capture device 302 is configured to interface with the device 10 and receive performance data 16 and/or performance statistics 24 reflecting each player's performance. The capture device 302 may be placed in electrical communication with a workstation 50 and an association terminal 304. In one embodiment, the electrical communication is achieved through communication cables 306, such as a UBS connector cable. Alternatively, the capture device 302, workstation 50, and the association terminal 304 may be placed in electrical communication through the use of a conventional network. Thus enabled, the capture device 302 may send performance data and statistics 16, 24 reflecting a player's performance to the workstation 50 and the association terminal 304.

The association terminal 304 may be configured similarly to the workstation 50. The association terminal 304 may include a handicap module 308 configured to determine player handicaps based on received performance data 16 and in accordance with association guidelines.

The scoring system 300 may be established throughout a golf course with a plurality of capture devices 302 in electrical communication with one or more workstations 50 and association terminals 304. The system 300 allows players to download their scoring history reflected in the performance data 16 and performance statistics 24 from any device 10 to a workstation 50 or association terminal 304. In this manner, the performance data and statistics 16, 24 may be consolidated, analyzed, reviewed, and compared. The scoring system 300 is advantageous for tournament play to receive and process numerous player scores.

Figure 4:
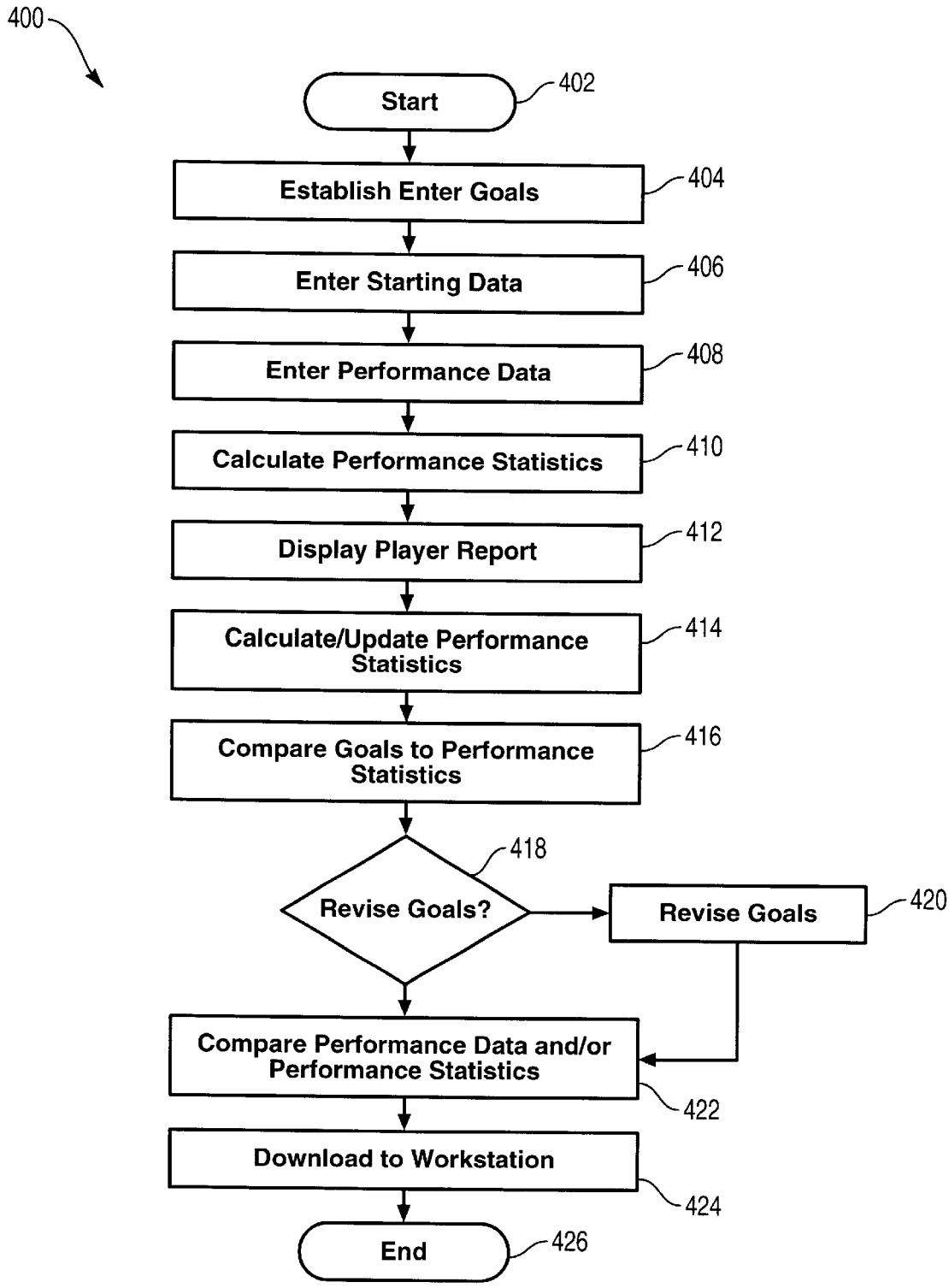
FIG. 4 is a flow diagram illustrating steps which may be performed in accordance with the present invention.

Referring to FIG. 4, a flow diagram 400 illustrating steps that may be performed in accordance with use of the device 10 is shown. The steps are shown for illustrative purposes and need not be performed in any particular order. Furthermore, one one or more steps may be omitted by a player and still be within the scope of the present invention.

In step 402, the process begins. In step 404, the player establishes goals. The player interface module 18 may generate an option for the player to select to enter goals. The interface module 18 may then generate a template to prompt for goal data. The template may prompt for elements and may be limited to certain parameters. In one embodiment, the device 10 may prompt for the following elements with associated parameters:

GOALS

| CATEGORY | PARAMETER |
|---|---|
| % Drives in FairwayRange | 0 to 100 |
| Average Driving DistanceRange | 100 to 350 |
| % Greens in RegulationRange | 0 to 100 |
| % Up and DownsRange | 0 to 100 |
| % Sand SavesRange | 0 to 100 |
| Putts/RoundRange | 18 to 40 |
| Putts/HoleRange | 17 to 3 |
| Putts/GIRRange | 1 to 3 |
| Penalty StrokesRange | 0 to 20 |
| Total ScoreRange | 60 to 200. |

The list of possible goal data elements is for illustrative purposes only and may vary as desired by a player. The player enters goal data for the elements which is saved in the memory 14. The goal data may be saved with the starting data 38 or in its own location.

In step 406, the player enters starting data 38 into the device 10 which is saved in the memory 14. The interface module 18 may generate prompts for the starting data 38 which are displayed on the output device 30. The starting data 38 may include the number of players, player identification, holes to be played, date played, course identification, tees to be played and so forth.

In step 408, the player enters performance data 16 into the device 10 during game play. The performance data 16 may be entered into the input device 20 and saved in the memory 14. The data organizer module 20 is configured to save the performance data 16 in appropriate locations in the memory 14. The performance data 16 may also be downloaded to the device 10 through the port 22. The performance data 16 may be entered in association with a player identification. As such, the interface module 18 generates prompts for each player in association with each player identification. The performance data 16 may be entered after a round or group of rounds of golf. The performance data 16 may include various elements which reflect game play and elements that may be entered include:

Drives in Fairway;
Possible Drives in Fairway;
Average Driving Distance;
Greens in Regulation;
Up and Downs;
Possible Up and Downs;
Sand Saves;
Possible Sand Saves;
Total Putts;
Total GIR Putts;
Holes Played; and
Total Score.

In step 410, the statistic module 22 determines performance statistics 24 based on the performance data 16 accumulated during game play. The following performance statistics 24 may be calculated after each hole is played and updated after play of a subsequent hole:

Number of drives in fairway divided by applicable number of holes;
Total driving distance divided by number of applicable holes;
Number of greens in regulation divided by number of holes;
Number of up n downs made divided by applicable number of holes;
Number of Sand Saves made divided by applicable number of holes;
Total putts for holes played, putts per hole for all holes played, putts per hole for all holes when on the Green in Regulation;
Total penalty strokes; and
Total score.

After a round of golf is completed the statistic module 22 may compute the following performance statistics for each player:

% Drives in the Fairway=#drives in fairway divided by # potential drives in fairway;
% Green in Regulation (GIR)=# GIR divided by # holes played;
% Up and Downs=#up and downs divided by # possible up and downs;
% Sand Saves=sand saves divided by # possible sand saves;
Putts per Hole=total putts divided by # holes played; and
Putts per GIR=total GIR putts divided by # greens in regulation.

In step 412, the interface module 18 may generate a player report and display the report on the output device 30. The player report may be provided for each round played and, in one embodiment, is displayed in a matrix format. The player report may include previously entered input, performance data 16, and performance statistics 24. For illustrative purposes, a player report may contain the following information:

| | |
|---|---|
| Player Identification | David Fondue |
| Date of Play | 5/5/98 |
| Course Played | Bonneville |
| Tees Played | Blue |
| % Drives in Fairway | 56.6 |
| Average Driving Distance | 256 |
| % GIR | 44.4 |
| % Up and Downs | 37.5 |
| % Sand Saves | 25.0 |
| Total Putts | 34 |
| Putts per Hole | 1.94 |
| Putts per GIR | 1.88 |
| Total Score | 82. |

The player report may reflect the performance of one round of golf.

In step 414, the statistic module 22 may calculate overall performance statistics 24 after a round of golf. The overall performance statistics 24 are specific to an individual player. The overall performance statistics 24 are preferably updated after each round for each player. After a round is completed the results, the statistic module 22 compiles the performance statistics 24 for that round with performance statistics 24 from previous rounds to generate the overall performance statistics 24. If two or more rounds relating to a player are downloaded from the device 10 to the workstation 26, the workstation 26 may calculate overall performance statistics 24 for those player rounds in the memory 30. Averages for the overall performance statistics 24 are based on absolute totals for each round. For example, if Driving Distance for round 1 was 250 and driving Distance for round 2 was 260, then the average Driving Distance will be 255. Thus, the average is not a total of all driving distance of the two rounds divided by all applicable holes.

The overall performance statistics 24 may further include the following calculations based on the performance data 16:

Total # Drives in Fairway divided by # Possible Drives;
Total Average Driving Distances divided by Applicable Holes;
Total # GIR divided by Total # Holes Played;
Total # Up and Downs divided by Total # Possible Up and Downs;
Total # Sand Saves divided by Total # Possible Sand Saves;
Total # of Putts divided by Round (requires converting a 9 hole rounds to 18 hole rounds by multiplying # of total putts for 9 hole rounds by 2, then add up adjusted total putts for all rounds and divide by total number of rounds);
Total # of Putts divided by Total # of Holes Played;
Total # of Penalty Strokes divided by Total Number of Rounds;
Total # of GIR Putts divided by Total Number of GIR;
Total Penalty Strokes divided by Round (multiplied by 2 for 9 hole rounds); and
Total Score divided by Round (requires converting 9 hole scores to 18 hole scores by multiplying 9 hole scores by 2, adding adjusted total, then divide by total number of rounds).

In step 416, the player may select an option to (compare performance data 16 and performance statistics 24 to the goals established in step 404. The review module 25 may retrieve the goal data, performance data 16, and performance statistics 24 and assemble them in a matrix format. The review module 25 may further compute the variance between the performance data 16 and the performance statistics 24 and the goals. The variance may be included in the goal report. The goal report may be generated after one round of golf or for a group of rounds as desired by the golfer.

In step 418, the player decides whether or not to revise the goals. Although revising the goals may be performed at any time, it is shown in the process for illustrative purposes. If the player decides to revise the goals established in step 404, the player proceeds to step 420 and enters new goals which are stored in memory 14. From this point on, performance data 16 and performance statistics 24 are compared against the revised goals.

In step 422, the player selects an option to review performance data 16 and performance statistics 24 for a round or rounds of golf. All performance data 16 and performance statistics 24 for each respective round are saved in association with a player for future review. Based on player input, the review module 25 selects performance data 16 and performance statistics 24 for a certain number of rounds such as the last 5, 10, or all rounds of golf. The review module 25 may generate performance data 16 and performance statistics 24, compare them to goals, and compute respective variances from the results to the goals.

The review module 25 is configured with the ability to recall performance data 16 and performance statistics 24 as desired by a player. The performance data 16 and performance statistics 24 may be selectively retrieved based on a player, a specific course, specific dates, or time periods. The selectively retrieved performance data 16 and performance statistics 24 may be compared to overall performance data 16 and performance statistics 24.

At the end of a round of golf, whether 9 hole or 18 hole, the interface module 18 prompts each player for an option to revise or save the performance data 16 and performance statistics 24. If a player is satisfied that the performance data 16 is correct, the review module 25 may make a final save of the performance data. After the last player has confirmed a save of the performance data 16, the interface module 18 may prompt to confirm that the round is completed and to save all performance data 16. If a player enters that the player has not completed a review, then the player is allowed to review the performance data 16 again for that round. If the player confirms that the player is done, then the device 10 may turn itself off.

If for some reason the round is ended prematurely, the device 10 may be reset back to the beginning of a round set up for a next round. This is anticipated to be a rare occurrence and should be done through unusual input to avoid accidental entry. In one embodiment, the unusual input requires scrolling to Off on a main menu and pushing Enter. In ending prematurely, the performance data 16 is not saved as it would throw off calculations based on either 9 hole or 18 hole rounds.

The review module 25 is further configured to allow for a review of performance data 16 and performance statistics 24 at any time during game play. After any hole is completed, and prior to completion of the round, a review of results either by hole or total results can be viewed by entering a review option from a main menu. The player is then prompted to enter the player identification. The interface module 18 may then prompt a player to ask if the player wishes to see the total results or not. If the player enters an affirmative, then the output device 30 displays the totals for each scoring element for the round up to that point. For illustrative purposes, a review report may display the following, with absolute numbers and percentage results where applicable:

| | |
|---|---|
| DIF | 38% (5 fairways hit out of 13 possible after 17th hole); |
| Dr Dis | 254(out of 10 applicable holes total of 2540 yards divided by 10); |
| GIR | 6 35%(6 greens in regulation out of the 17 holes played); |
| UnD | 4 36%(4 up and downs made out of the 11 holes not hit in regulation); |
| Sandies | 1 50% (1 sand made of out 2 possible); |
| Putts | 31 1.82(31 total putts for 17 holes equals 1.82 putts/hole); |
| GIR Putts | 13 2.16(13 putts when on green in regulation or 2.16 putts/GIR hole); |
| Pen | 0 (0 penalty strokes for the round); and |
| Score | 81. |

If the player enters in the negative, then the interface module 18 may prompt to know if results for each hole are requested. If not, then the review module 25 goes back to the next hole to be played. If yes, then the review module 25 goes to hole one, first element for the player being reviewed. To review each element for a hole, the player may scroll up and down until the review is completed. When the review is completed the player may push an enter key to return to the next hole to be played.

Between rounds, if a player wants to review a player's previous rounds and totals, the player may do so by turning on the device 10 and entering 0 for the number of players. The player may then scroll down to a review option and press enter. The interface module 18 may then prompt for player identification as in the start up mode. After inputting the player's identification, the interface module 18 may ask if the player wants to review all rounds. If yes, the review module 25 generates compiled averages for all rounds for each element.

If no, the interface module 25 may ask for which round. The round may be identified by the date of play. The output device 30 may list the rounds played in chronological order. The player may scroll to the round the player wants to review and select that round. The player may further scroll through elements for the selected round using the normal review function. The player can either review totals for the round or hole by hole. If the player wants to review additional rounds, the player may push Enter to go back to the beginning of round set up select the review option from a menu to start the process over.

At the end of the review, the player can simply turn off the device 10 which will automatically send the device back to the beginning of round set up. Alternatively, the player may select Back to go the beginning of a round set up.

The review module 25 is further configured to allow a player to make corrections to the performance data 16. In one embodiment, the review module 25 only permits correction of a current game. During review, a player can make corrections to an element by scrolling to and selecting the revise option. When the revise option is entered, the listed element returns to a default entry. The player then enters a correct input. The player may continue the review by entering the review option or may proceed to the next hole by pressing the Enter key.

In step 424, the player may download the performance data 16 and performance statistics 24 from the memory 14 to the workstation 50. The workstation 50 may store the received performance data 16 and performance statistics 24 in its memory 54. The performance data 16 and performance statistics 24 may be stored for a plurality of golfers. Performance data 16 and performance statistics 24 may be retrieved which are specific to an individual golfer by entering a golfer's identification. In one embodiment, the memory 54 may have the ability to hold up to 1000 rounds worth of performance data 16 and related performance statistics 24. For many plasters, 1000 rounds is sufficient for a lifetime of golf. Once 1000 rounds are completed, the performance data 16 and performance statistics 24 may be downloaded to another memory storage such as a Zip disc. It is anticipated that as advances in memory capability continue, the amount of performance data 16 and performance statistics 24 which may be stored will increase substantially.

At the end of a round, the player may download performance data and statistics from the device 10 to a workstation 26 or an association terminal 304. This is useful for tournament play in order to consolidate performance data and statistics or for determining player handicaps in an association handicap system. To perform a download, the player may select a download function from a menu. The player then places the device 10 in electrical communication with the capture device 302.

The memory 54 contains modules which are configured to receive goals, calculate performance statistics 24, display a player report, calculate/update overall performance statistics 24, compare goals to actual performance, revise goals, and review performance data 16 and performance statistics 24 as previously described in steps 404, 408, 410, 412, 414, 416, 420, and 422. The device 10 may be hand-held and is conveniently transported during game play, whereas the workstation 50 may be a desktop or laptop computer and not as mobile. Thus, although the workstation 50 may have superior processing and storage capability, the device 10 is preferred during game play. The advantages of the workstation 50 are incorporated when performance data 16 is downloaded to the workstation 50.

Referring to FIG. 5, a sample output is shown as it may be displayed on the output device 30 of the device 10 or the output device 66 of the workstation 50. The output is in matrix format and lists performance data 16, such as the score, as well as performance statistics 24. Both the performance data 16 and the performance statistics 24 are listed with respect to an individual player. Review averages are not the average percent for 10 rounds played but are absolute average of shots made versus possible shots in that category.

The present invention provides a hand-held portable device capable of tracking and incorporating valuable performance statistics 26 to allow a player to identify weaknesses in game play. A player is then able to focus efforts on that weakness to improve a player's performance. A player is able to quickly enter, review, and revise performance data through a simple input device 34. The device 10 computes the performance statistics 26, presents the results, and compares them to pre-established goals at anytime that a player desires. The device 10 accommodates results for a single player or multiple players and tracks performance during a round and compiles results for multiple rounds. The results may further be downloaded from the device 10 to a workstation 50 for further review or long term storage.

The present invention may be embodied in other specific forms without departing from its scope or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A hand-held device for storing and processing performance data reflecting golf scores, the device comprising:

an interface module configured to generate prompts for player data, goal data, and performance data;

an output device in electrical communication with the interface module and configured to display the prompts;

an input device in electrical communication with the interface module and configured to receive performance data;

a memory in electrical communication with the input device and configured to receive and store the performance data; and a statistic module configured to generate performance statistics based on the performance data; and a review module configured to retrieve selected performance data and performance statistics in response to a player's request and generate a comparison of the goal data to the performance data and the performance statistics, the interface module configured to generate a player report reflecting the performance data, the performance statistics, and the player information, the output device configured to display the player report.

2. The device of claim 1, wherein the input device consists of an enter button and a plurality of keypad buttons, the keypad buttons configured to allow scrolling through options presented by the interface module.

3. The device of claim 1, further comprising a port in electrical communication with the memory and configured to place the device in electrical communication with a workstation.

4. The device of claim 1, wherein the review module is configured to revise performance data in accordance with corrections entered by a player.

5. The device of claim 1, wherein the player data includes player identifications and wherein the performance data and the performance statistics are associated with specific player identifications.

6. A method for storing and processing performance data reflecting golf scores, comprising:

receiving performance data into a hand-held device;

storing the performance data in a memory in the hand held device;

receiving goal data reflecting player goals;

storing the goal data in the memory;

calculating performance statistics based on the performance data;

storing the performance statistics in the memory;

calculating a variance between the goal data and the performance data; and generating a report incorporating the performance data, the goal data, and the performance statistics.

7. The method of claim 6 further comprising, downloading the performance data and the performance statistics from the memory to a computer workstation.

8. The method of claim 6 further comprising, retrieving select performance data and performance statistics from the memory in response to a received request; and displaying the select performance data and performance statistics.

9. The method of claim 6 further comprising, revising performance data in accordance with received corrections.

10. The method of claim 6 further comprising, receiving player data including one or more player identifications; and associating performance data and performance statistics with a specific player identification.

11. The method of claim 10 further comprising, receiving a request for select performance data and performance statistics based on a selected player identification; and generating a report of select performance data and performance statistics in association with the player identification.

12. A computer readable medium having stored thereon computer executable instructions for performing a method for storing and processing performance data reflecting golf scores, the method comprising:

receiving performance data into a hand-held device;

storing the performance data in a memory in the hand held device;

receiving goal data reflecting player goals;

storing the goal data in the memory;

calculating performance statistics based on the performance data;

storing the performance statistics in the memory;

calculating a variance between the goal data and the performance data; and generating a report incorporating the performance data, the goal data, and the performance statistics.

13. The computer readable medium of claim 12, wherein the method further comprises, downloading the performance data and the performance statistics from the memory to a computer workstation.

14. The computer readable medium of claim 12, wherein the method further comprises, retrieving select performance data and performance statistics from the memory in response to a received request; and displaying the select performance data and performance statistics.

15. The computer readable medium of claim 12, wherein the method further comprises, revising performance data in accordance with received corrections.

16. The computer readable medium of claim 12, wherein the method further comprises, receiving player data including player one or more identifications; and associating performance data and performance statistics with a specific player identification.

17. The computer readable medium of claim 16, wherein the method further comprises, receiving a request for select performance data and performance statistics based on a selected player identification; and generating a report of select performance data and performance statistics in association with the player identification.

* * * * *